United States Patent [19]

Mickelson

[11] Patent Number: 5,010,630

[45] Date of Patent: Apr. 30, 1991

[54] CLASP MECHANISM

[76] Inventor: Steven E. Mickelson, 1509 W. Seventh St., Red Wing, Minn. 55066

[21] Appl. No.: 451,043

[22] Filed: Dec. 15, 1989

[51] Int. Cl.[5] ..... A44C 5/00

[52] U.S. Cl. ..... 24/647; 24/650

[58] Field of Search ..... 24/647, 635, 636, 637, 24/638, 650, 664, 665, 677

[56] References Cited

U.S. PATENT DOCUMENTS

| | | | |
|---|---|---|---|
| 1,369,064 | 2/1921 | Toyama | 24/664 X |
| 2,904,347 | 9/1959 | Tucker | 24/647 X |
| 3,203,064 | 8/1965 | Murphy | 24/650 |
| 3,594,872 | 7/1971 | Kalwin et al. | 24/650 |
| 3,639,951 | 2/1972 | Inoue et al. | 24/650 |

FOREIGN PATENT DOCUMENTS

| | | | |
|---|---|---|---|
| 96034 | 9/1922 | Switzerland | 24/650 |
| 21739 | of 1893 | United Kingdom | 24/650 |

*Primary Examiner*—Laurie K. Cranmer
*Attorney, Agent, or Firm*—William J. Ryan

[57] ABSTRACT

A clasp is provided that is fixed to one end of a chain or similar device and includes an internal latch mechanism for releasably engaging the free end of the chain, wherein the latch mechanism includes a spring biased, deflectable member carrying a lug that (when the chain is tensioned across the clasp) deflects to a position adjacent the clasp casing wherein the lug seats in a depression formed in the casing interior to more securely engage the free end of the chain.

4 Claims, 2 Drawing Sheets

CLASP MECHANISM

SUMMARY OF THE INVENTION

The present invention relates to a releasable clasp designed to releasably couple the ends of a chain, necklace, bracelet or similar device.

A variety of clasps have been known and used in the past for coupling the ends of various types of jewelry and wearing apparel once placed around the body of the wearer. Such clasps are generally fixed to one end of the chain and provide a latch mechanism for releasably securing the other, free end of the chain to the clasp. The latch mechanisms are generally released by manual manipulation. Such clasps also have utility in securing articles other than jewelry. For instance, in many medical applications an article such as a tube or tracheal catheter is secured in close proximity to the arm or neck of the patient by a bracelet or chain wrapped around the patient's arm or neck. It will be understood that the present invention may be used advantageously in all such applications. The invention will be described, however, with respect to a chain from this point onward.

The primary object of the invention is to provide a releasable clasp which is designed to prevent accidental release of the coupled ends of the chain as a result of increased tension on the chain across the clasp. To that end, a clasp is provided that is fixed to one end of the chain and includes an internal latch mechanism to releasably engage the free end of the chain, wherein the latch mechanism includes a spring biased, deflectable member carrying a lug that (when the chain is tensioned across the clasp) deflects to a position adjacent the clasp casing wherein the lug seats in a depression formed in the casing interior to more securely engage the free end of the chain.

DETAILED DESCRIPTION OF THE PREFERRED EMBODIMENT

Figure 1:
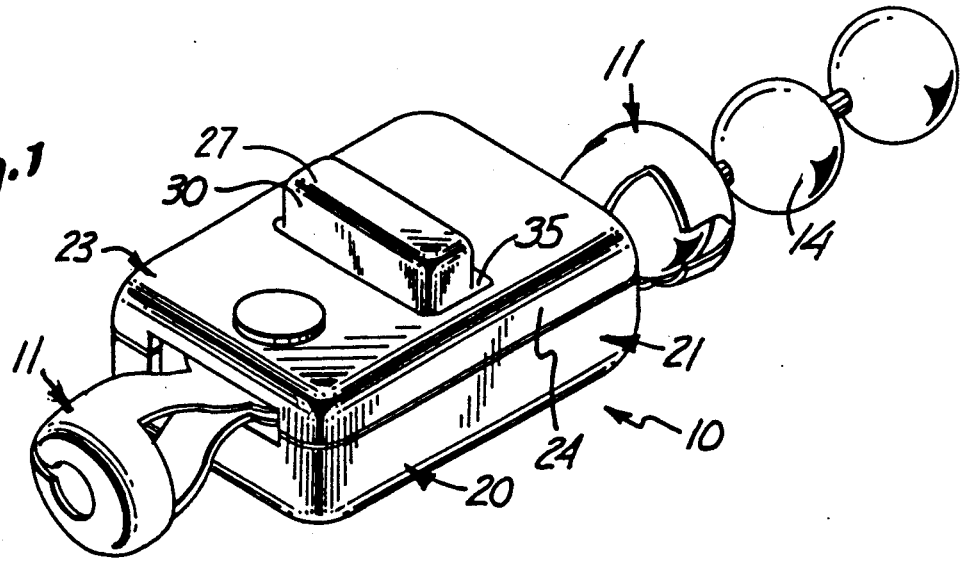
FIG. 1 is a perspective view showing an assembled clasp according to the present invention.

Referring to the drawing, wherein like numerals represent like elements throughout the several views, there is provided a releasable clasp generally designated 10. The clasp 10 is designed to releasably join the opposing ends of a chain or similar device, each end having attached thereto an end piece 11 having a circular, generally planar clasp engaging portion 12, each of such portions 12 defining a central opening 13. The opposing ends of the chain or similar device are attached to end pieces 11 in any suitable manner. The first end 14 of the chain is permanently attached to the clasp 10 in a manner described below that will allow some limited degree of motion or movement with respect to the clasp 10. The second end 15 of the chain is releasably attached to the clasp 10 in a manner to be described, opposite the first end 14.

The clasp 10 comprises a hollow casing 20 having a lower portion 21 with upwardly depending sidewalls 22 and an upper portion 23 with downwardly depending sidewalls 24. When in place, the ends of the casing 20 define a front opening 40 and a rear opening 41 through which the end pieces 11 extend. An opening 35 is also defined in upper portion 23 extending across its width.

A generally cylindrical, upwardly extending post 25 is formed at one end of the lower portion 21. Spring means 26 are positioned at the other end of lower portion 21 opposite post 25. In the preferred embodiment, spring means 26 comprises a piece of foam rubber or similar resilient material that will return to its original shape and size when compressed. Other types of spring means will be possible within the scope of this invention, however.

The radial size of post 25 is such that post 25 can be passed through or received in the opening 13 of the end piece 11 attached to the first end 14 of the chain. In construction, the clasp engaging portion 12 of end piece 11 of end 14 is placed over post 25 such that post 25 extends through the opening 13. Thus it will be seen that upon completion of the assembly of clasp 10, the first end 14 of the chain will be permanently attached to clasp 10, although there will be some degree of movement possible within rear opening 41 relative to clasp 10.

Overlying the clasp engaging portion 12 of the end piece 11 attached to the first end 14 of the chain and spring means 26 is a generally inverted "T" shaped member 27 having first and second horizontal portions 28, 29 and an upwardly extending finger portion 30 positioned essentially centrally between the horizontal portions 28, 29. The first horizontal portion 28 has an opening 31 defined therein sized to receive post 25. When in place, post 25 is passed through opening 31 such that first horizontal portion 28 overlies portion 12 of end piece 11 attached to first end 14 of the chain and the second horizontal portion 29 overlies spring means 26.

The upper surface of second horizontal portion 29 carries an upwardly projecting, forwardly tapering lug 32. The lug 32 is generally cylindrical in shape and terminates at its upper end at an upper surface 33 which is inclined downwardly toward the front end of casing 20.

Upper portion 23 of the casing 20 has a downwardly depending annular collar 34 having an inner radius slightly larger than the radius of post 25. The collar 34 is positioned at one end of the upper portion 23 of casing 20 corresponding to the relative position of post 25 with respect to the lower portion 21.

The under surface of upper portion 23 defines a depressed or recessed area 36 at a position corresponding to the relative position of lug 32 with respect to member 27. The recessed area 36 is shaped in such a manner that the upper end of lug 32 may be received therein. A shoulder position 37 located adjacent opening 35 on the underside of upper portion 23 defines recessed area 36.

When in position, it will be seen that the collar 34 receives the top end of post 25 and the finger portion 30 of member 27 extends upwardly through opening 35.

Once the various components have been assembled, the lower and upper portions 21, 23 of casing 20 are joined in any suitable manner as by an adhesive joining their respective sidewalls 22, 24.

Figure 3:
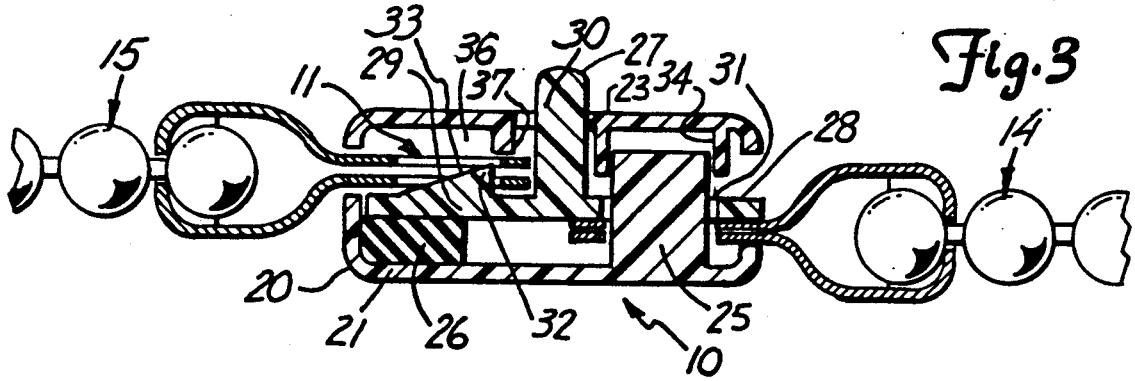
FIG. 3 is a side sectional view showing a clasp according to the present invention in engaged position.
Figure 4:
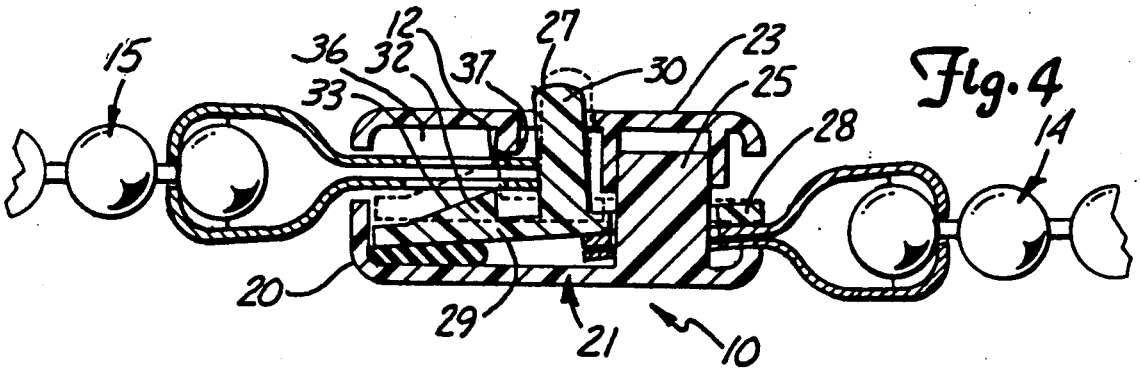
FIG. 4 is a side sectional view of a clasp according to the present invention in releasable position and further showing the engaged position in dashed line.

In operation, it will be seen that to join the ends of the chain, end piece 11 attached to the second, free end 15 is inserted into the clasp 10 through the front opening 40 in casing 20. The clasp engaging portion 12 of said end piece 11 will engage the inclined upper surface 33 of lug 32, causing it to deflect downwardly against spring means 26. Once the clasp engaging portion 12 has cleared the top of lug 32, lug 32 will be urged by spring means 26 up through opening 13 thereby joining ends 14 and 15 as seen in FIG. 3. This represents the normal, engaged configuration of the chain and clasp when the chain is not tensioned. To release the opposing ends of the chain, the user depresses finger portion 30 of member 27, thereby deflecting horizontal portion 29 against spring means 26 until the end piece 11 clears lug 32. One end piece 11 has been removed from casing 20, the finger portion 30 is released and the horizontal portion 29 of member 27 will be returned to its normal position by spring means 26.

Figure 5:
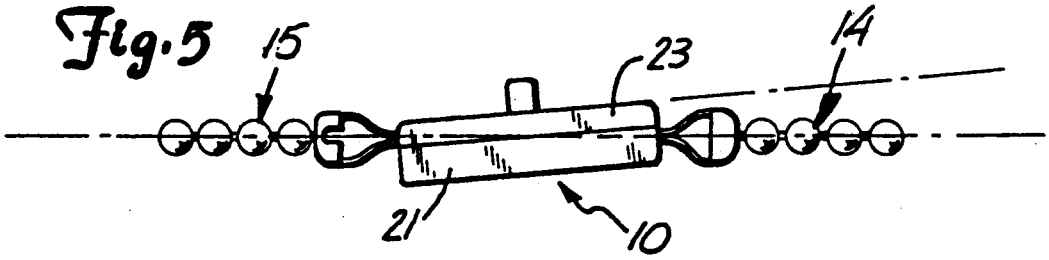
FIG. 5 is a side plan view showing the relative position of a clasp according to the present invention when the chain is tensioned.
Figure 2:
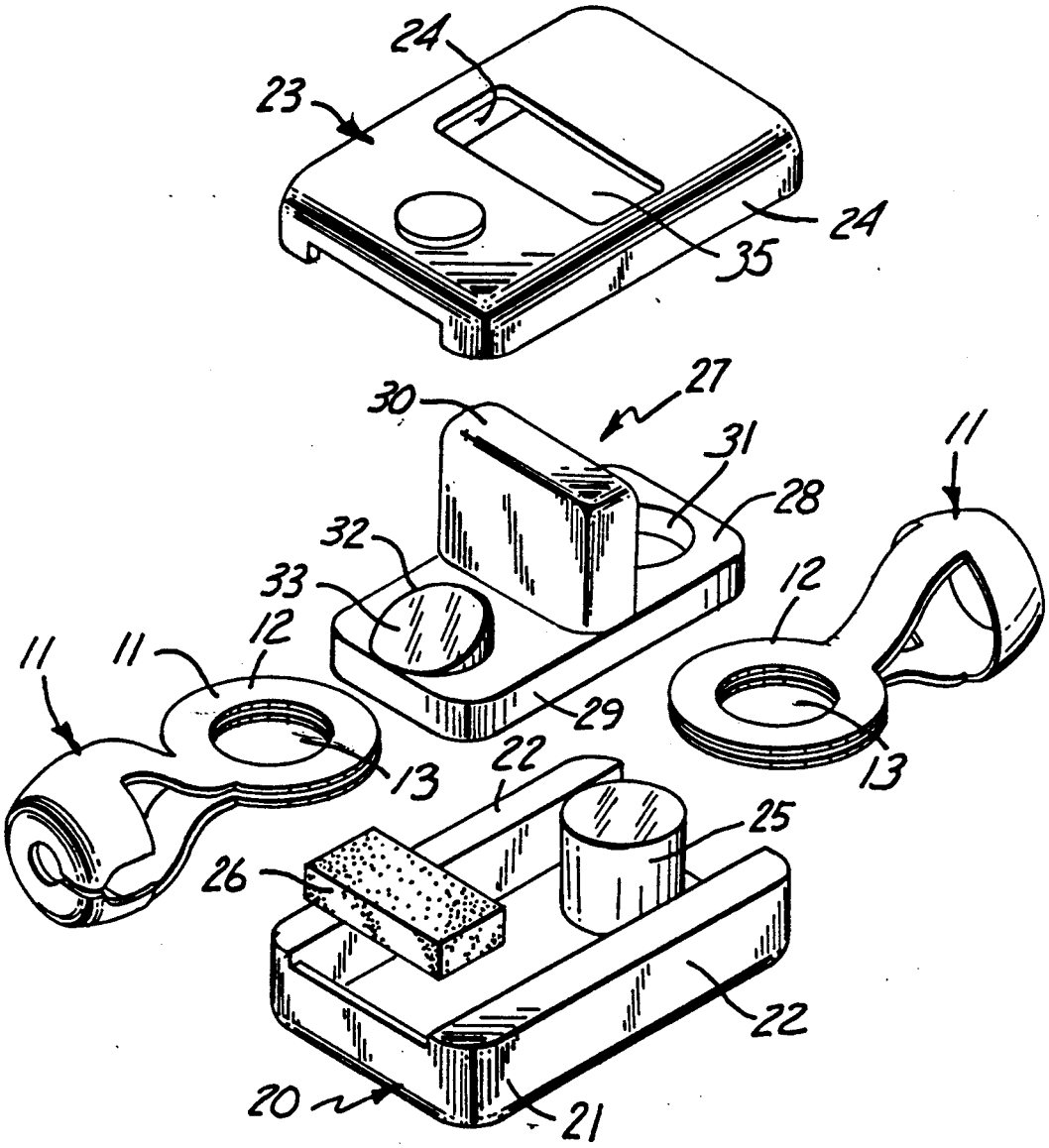
FIG. 2 is an exploded perspective view showing each of the elements of a clasp according to the present invention.
Figure 6:
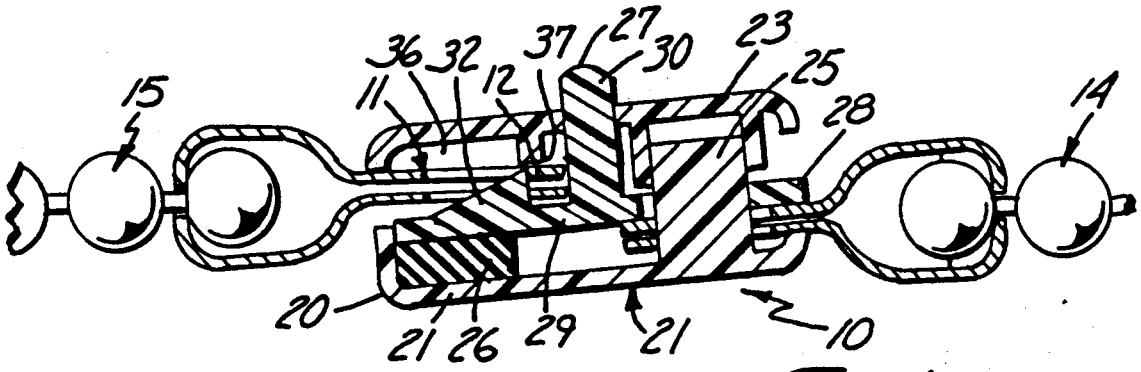
FIG. 6 is a side sectional view of a clasp according to the present invention when the chain is under tension.

As seen in FIG. 5, when the chain is tensioned, the clasp 10 will be angularly displaced with respect to the chain. This occurs by virtue of the relatively different vertical positions of the end pieces 11 with respect to the horizontal portions 28, 29 of member 27 (i.e., the end pieces 11 are positioned on opposite sides of horizontal portions 28, 29). With the chain under tension, the corresponding end piece 11 attached to the second, free end 15 of the chain bears against lug 32. Due to the angular displacement of the clasp 10 with respect to the chain (and thus the vector of the tension), a component of force is applied to lug 32 that tends to deflect that end of horizontal portion 29 toward the recessed area 36. As that end of horizontal portion 29 as deflected in the recessed area 36, shoulder 37 passes behind lug 32 until it ultimately bears against the clasp engaging portion 12 of end piece 11 if sufficient tension is applied. Thus, it will be seen that as shoulder 37 passes behind lug 32, it impedes accidental slippage of end piece 11 over lug 32. The inventor has found this feature to be particularly beneficial when the chain is accidentally tensioned as, for instance, if the chain is accidentally caught or snagged.

While I have described the preferred embodiment of my invention, it will be apparent to those of ordinary skill in the art that other embodiments are possible within the spirit of my invention.

What is claimed is:

1. A clasp for releasably securing opposed first and second ends of a strand, wherein said clasp is adapted to be secured to said first end of said strand and to releasably engage said second end of said strand, said clasp comprising:

(a) A casing having top and bottom portions defining a first and second end, each of said first and second ends having an opening defined therein;

(b) A post positioned within said casing connecting said top and bottom portions adjacent said opening in said first end of said casing;

(c) A first end engaging element adapted to engage said first end of said strand, said first end engaging element being secured to said post;

(d) A latch member mounted within said casing to said post, said latch member having an upwardly projecting lug located adjacent said opening in said second end of said casing, said latch member being operable between a first, engaged position and a second, disengaged position;

(e) Springs means for biasing said latch member in said first, engaged position;

(f) A second end engaging element adapted to be secured to said second end of said strand, said second end engaging element being insertable through said opening in said second end of said casing for engagement with said lug of said latch member; and (g) Means for deflecting said latch member from said first, engaged position to said second, disengaged position.

2. A clasp according to claim 1 wherein said top portion of said casing defines a recessed area immediately above said lug.

3. A clasp for releasably securing opposed first and second ends of a strand, wherein said clasp is adapted to be secured to said first end of said strand and to releasably engage said second end of said strand, said clasp comprising:

(a) A casing having top and bottom portions defining a first and second end, each of said first and second ends having an opening defined therein;

(b) A post positioned within said casing connecting said top and bottom portions adjacent said opening in said first end of said casing;

(c) A first end engaging element defining a post-receiving opening and being adapted to engage said first end of said strand, said first end engaging element being inserted into said opening in said first end of said casing and being secured to said post by insertion of said post through said opening in said first end engaging element;

(d) A generally planar latch member having opposed first and second ends, said latch member having a post-receiving opening defined in said first end and an upwardly projecting lug on said second end, said latch member being secured to said post by insertion of said post in said post-receiving opening such that said lug is located adjacent said opening in said second end of said casing, said latch member being operable between the first, engaged position and a second, disengaged position;

(e) Spring means for biasing said latch member in said first, engaged position;

(f) A second end engaging element adapted to be secured to said second end of said strand, said second end element being insertable through said opening in said second end of said casing for engagement with said lug of said latch member; and (g) Means for deflecting said latch member from said first, engaged position to said second, disengaged position.

4. A clasp according to claim 3 wherein said top portion of said casing defines a recessed are immediately above said lug.

* * * * *